US008447054B2

(12) United States Patent
Bharatan et al.

(10) Patent No.: US 8,447,054 B2
(45) Date of Patent: May 21, 2013

(54) MICROPHONE WITH VARIABLE LOW FREQUENCY CUTOFF

(75) Inventors: Sushil Bharatan, Burlington, MA (US); Venkataraman Chandrasekaran, Mansfield, MA (US); Xin Zhang, Acton, MA (US); Michael W. Judy, Ipswich, MA (US)

(73) Assignee: Analog Devices, Inc., Norwood, MA (US)

( * ) Notice: Subject to any disclaimer, the term of this patent is extended or adjusted under 35 U.S.C. 154(b) by 393 days.

(21) Appl. No.: 12/909,933

(22) Filed: Oct. 22, 2010

(65) Prior Publication Data

US 2011/0110550 A1 May 12, 2011

Related U.S. Application Data

(60) Provisional application No. 61/260,092, filed on Nov. 11, 2009.

(51) Int. Cl.
*H04R 25/00* (2006.01)

(52) U.S. Cl.
USPC ..... 381/174; 381/358

(58) Field of Classification Search ..... 381/174, 381/175, 355–360; 137/15.19, 533.19
See application file for complete search history.

(56) References Cited

U.S. PATENT DOCUMENTS

| | | | | |
|---|---|---|---|---|
| 3,835,263 | A * | 9/1974 | Killion | 381/313 |
| 6,160,896 | A | 12/2000 | Macaluso et al. | 381/386 |
| 6,674,140 | B2 | 1/2004 | Martin | 257/415 |
| 6,781,231 | B2 | 8/2004 | Minervini | 257/704 |
| 7,233,679 | B2 * | 6/2007 | Muthuswamy et al. | 381/369 |
| 7,570,772 | B2 | 8/2009 | Sorensen et al. | 381/175 |
| 7,600,533 | B2 * | 10/2009 | Tai et al. | 137/516.25 |
| 8,141,573 | B2 * | 3/2012 | Tai et al. | 137/15.19 |
| 2007/0071268 | A1 * | 3/2007 | Harney et al. | 381/355 |
| 2010/0096711 | A1 | 4/2010 | Tian | 257/415 |

* cited by examiner

*Primary Examiner* — Davetta W Goins

*Assistant Examiner* — Phylesha Dabney

(74) *Attorney, Agent, or Firm* — Sunstein Kann Murphy & Timbers LLP

(57) ABSTRACT

A microphone system has a package with an interior, a MEMS microphone within the package interior and forming a backvolume between it and the package interior, and a MEMS valve coupled with at least one input aperture in the package. The package defines at least one input aperture (e.g., the prior noted aperture) for receiving an acoustic signal, and the MEMS microphone is mechanically coupled to at least a portion of one input aperture. The valve has a valve opening generally circumscribed by a valve seat. The valve is considered as having an open mode for permitting acoustic signal access into the package interior through the valve opening, and a closed mode for substantially preventing acoustic signal access into the package interior through the valve opening. The valve has a movable member configured to contact the valve seat when in the closed mode. This movable member is configured to move between the open mode and the closed mode in a direction that is generally perpendicular to the valve seat.

20 Claims, 6 Drawing Sheets

MICROPHONE WITH VARIABLE LOW FREQUENCY CUTOFF

PRIORITY

This patent application claims priority from provisional U.S. Patent Application No. 61/260,092 filed Nov. 11, 2009, entitled, "MICROPHONE WITH VARIABLE LOW FREQUENCY CUTOFF," and naming Sushil Bharatan, Venkataraman Chandrasekaran, Xin Zhang, and Michael Judy as inventors, the disclosure of which is incorporated herein, in its entirety, by reference.

FIELD OF THE INVENTION

The invention generally relates to microphones and, more particularly, the invention relates to controlling the sensitivity of a microphone.

BACKGROUND ART

Microphones intrinsically can detect a specific range of audio signal frequencies. Although many audio signals of interest typically are within that range, many undesirable audio noise signals typically are at that lower end of the range. For example, wind noise commonly has frequencies below 200 Hertz. To substantially eliminate this noise, a microphone simply may be configured to have a low frequency cutoff point (also known in the art as the "minus 3 DB point") of about 200 Hertz. A microphone configured in this manner therefore should not appreciably sense audio signals below about 200 Hertz.

One problem with this approach, however, is that some audio signals of interest also have frequencies below 200 Hertz. Accordingly, such "noise reducing" microphones cannot detect desirable low frequency audio signals. To avoid this problem, those in the art extend the low frequency cutoff to a much lower value, such as 40 Hertz.

This dilemma represents an ongoing tradeoff. Either a microphone can detect low frequency signals, and thus undesirably detect noise, or it does not detect noise but cannot detect desirable low frequency signals.

SUMMARY OF THE INVENTION

In accordance with one embodiment of the invention, a microphone system has a package with an interior, a MEMS microphone within the package interior and forming a backvolume between it and the package interior, and a MEMS valve coupled with at least one input aperture in the package. The package defines at least one input aperture (e.g., the prior noted aperture) for receiving an acoustic signal, and the MEMS microphone is mechanically coupled to at least a portion of one input aperture. The valve has a valve opening generally circumscribed by a valve seat. The valve is considered as having an open mode for permitting acoustic signal access into the package interior through the valve opening, and a closed mode for substantially preventing acoustic signal access into the package interior through the valve opening. The valve has a movable member configured to contact the valve seat when in the closed mode. This movable member is configured to move between the open mode and the closed mode in a direction that is generally perpendicular to the valve seat.

The movable member may substantially cover the valve opening when in the closed mode. In some embodiments, the movable member is electrically conductive and electrostatically attracted toward and away from the valve seat. Moreover, the valve may include a serpentine spring that controls movement of the movable member between the closed mode in the open mode.

The valve may have a main surface forming the valve opening, and the valve seat may include a raised surface protruding from this main surface. Alternatively, the valve seat may include a portion of the main surface. The valve also may have a variety of intermediate positions. For example, the valve may have a fully open position, a fully closed position, and a plurality of intermediate positions between the fully open and fully closed positions. In that case, the valve may be configured to stop the movable member at any one of the intermediate positions for a predetermined amount of time during use.

Various embodiments contemplate different arrangements. For example, the microphone and valve may be mounted over the same input aperture, and/or the microphone and valve may be formed on a single die. In addition, the system may include a noise detector coupled with the valve and configured to detect noise received by the microphone. The noise detector may be configured to reduce noise sensitivity of the microphone after detecting noise.

In accordance with another embodiment of the invention, a microphone system has a package that defines at least one input aperture for receiving an acoustic signal, and includes an interior and an electromagnetic interference mitigation shield. The system also includes 1) a MEMS microphone mounted within the interior of the package, where the microphone has a backvolume defined by the microphone and package, and 2) a MEMS valve acoustically coupled with at least one input aperture in the package.

The valve has a valve opening generally circumscribed by a valve seat, and, similar to other embodiments, may be considered to be in an open mode when permitting acoustic signal access into the package interior through the valve opening. In addition, this valve also is considered to have a closed mode for substantially preventing acoustic signal access into the package interior through the valve opening. To those ends, the valve has a movable member configured to contact the valve seat when in the closed mode. In illustrative embodiments, when moving between modes, the movable member is configured to move between the open mode and the closed mode in a direction that is generally perpendicular to the valve seat.

In accordance with another embodiment of the invention, a method of controlling a microphone provides a MEMS microphone system having a package forming an input aperture. The package also has an interior containing a microphone with a low frequency cutoff, where the microphone and package form a backvolume. The microphone system also has a MEMS valve with a valve seat and an opposed movable member. The method moves the movable member of the valve generally perpendicularly toward or generally perpendicularly away from the valve seat to vary the fluid flow resistance into the backvolume to control the low frequency cutoff of the microphone. In addition, the method receives an incident acoustic signal through the input aperture. Consequently, the microphone responds to the incident acoustic signal as a function of the low frequency cutoff of the microphone as controlled by the valve.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a microphone system dynamically varies its low frequency cutoff point. For example, the low frequency cutoff of such a microphone system may have a range of 20 Hz to 200 Hz. To that end, the system has a valve that controls fluid flow into the backvolume of the microphone. The low frequency cutoff thus varies as a function of the fluid flow permitted by the valve. To maintain a small footprint, the valve has a movable member that moves in a generally perpendicular direction relative to its valve seat. Details of illustrative embodiments are discussed below.

Figure 1A:
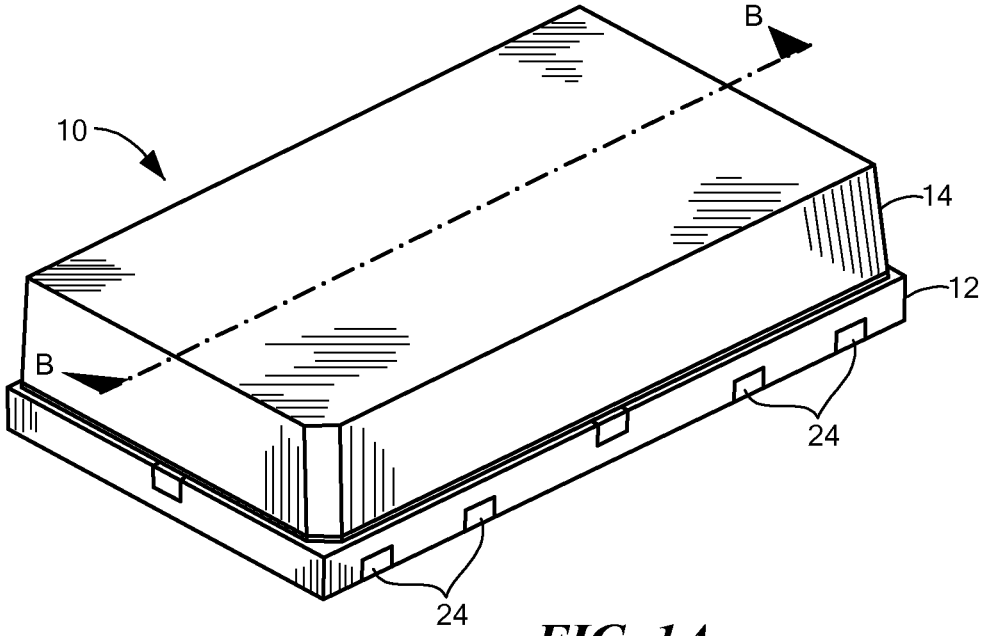
FIG. 1A schematically shows a top perspective view of a packaged microphone configured in accordance with illustrative embodiments of the invention.

FIG. 1A schematically shows a top, perspective view of a packaged microphone 10 (also referred to as a "packaged microchip 10") that may be configured in accordance with illustrative embodiments of the invention. In a corresponding manner, FIG. 1B schematically shows a bottom, perspective view of the same packaged microphone 10.

Figure 4A:
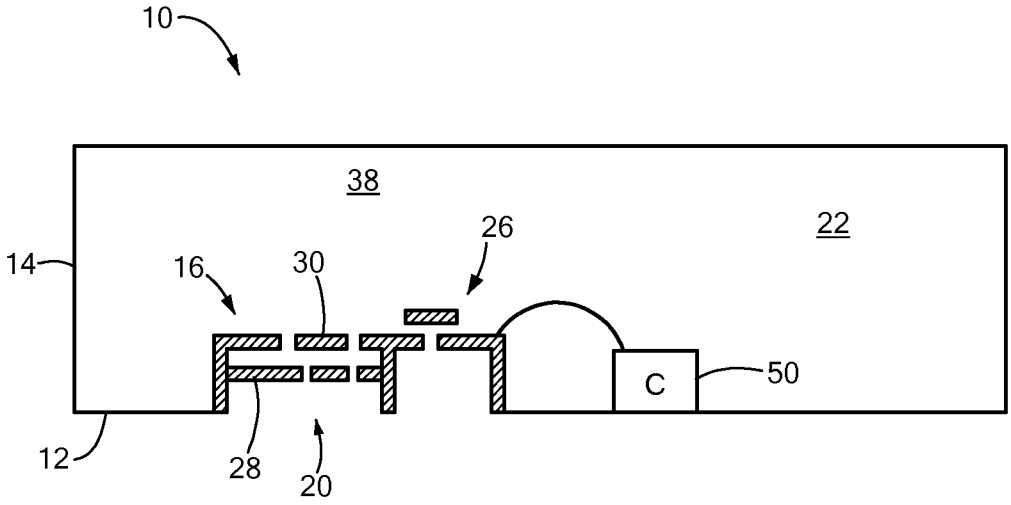
FIG. 4A schematically shows a cross-sectional view of an integral microphone and valve mounted over an input aperture of a package.
Figure 4B:
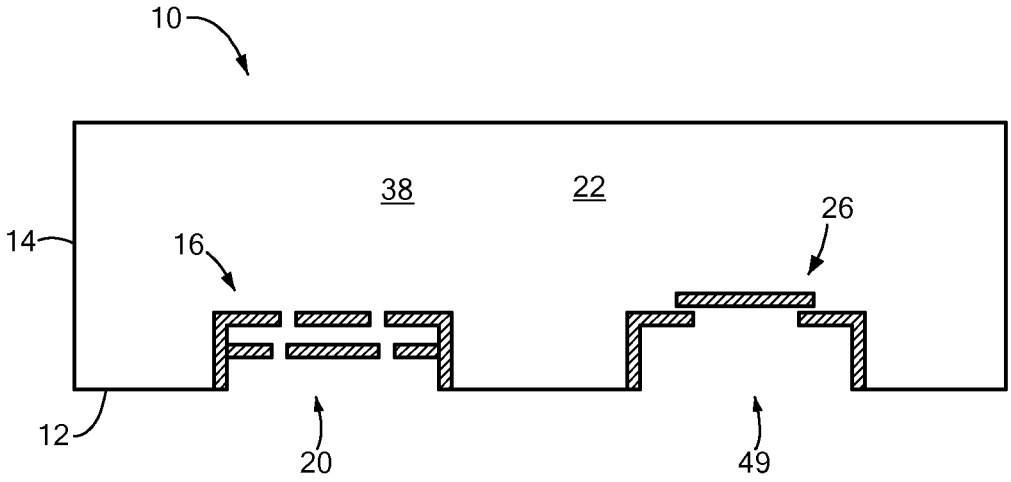
FIG. 4B schematically shows a cross-sectional view of another embodiment of the invention, in which a microphone chip and valve chip are mounted over separate apertures.
Figure 4C:
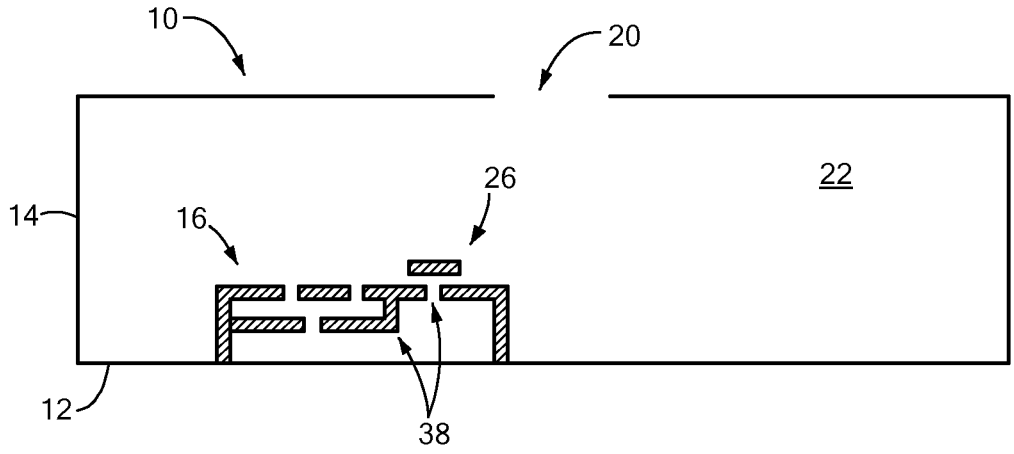
FIG. 4C schematically shows a cross-sectional view of another embodiment of the invention, in which an integral microphone and valve chip are mounted to a solid interior package surface.
Figure 4D:
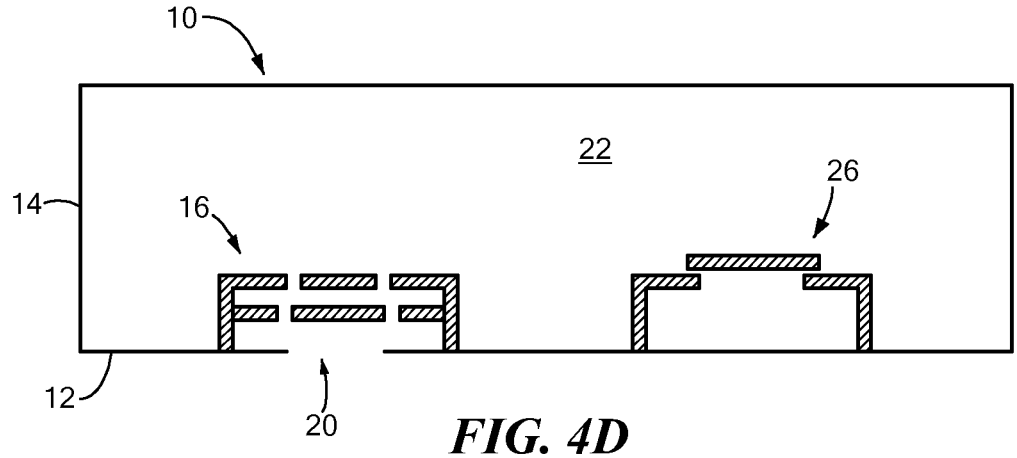
FIG. 4D schematically shows a cross-sectional view of another embodiment of the invention, in which a microphone chip is mounted over an input aperture, while a valve chip is mounted to a solid interior package surface.

The packaged microphone 10 shown in those figures has a package base 12 that, together with a corresponding lid 14, forms an internal chamber 22 (shown in subsequent figures) containing a MEMS microphone chip 16 (discussed below, see FIG. 2 and others and also referred to as "MEMS microphone 16") and, if desired, separate microphone circuitry 50 (shown schematically in FIG. 4A, but could be in other figures, such as in FIGS. 4B-4D). The lid 14 in this embodiment is a cavity-type lid, which has four walls extending generally orthogonally from a top, interior face to form a cavity. The lid 14 secures to the top face of the substantially flat package base 12 to form the internal chamber 22.

Figure 1B:
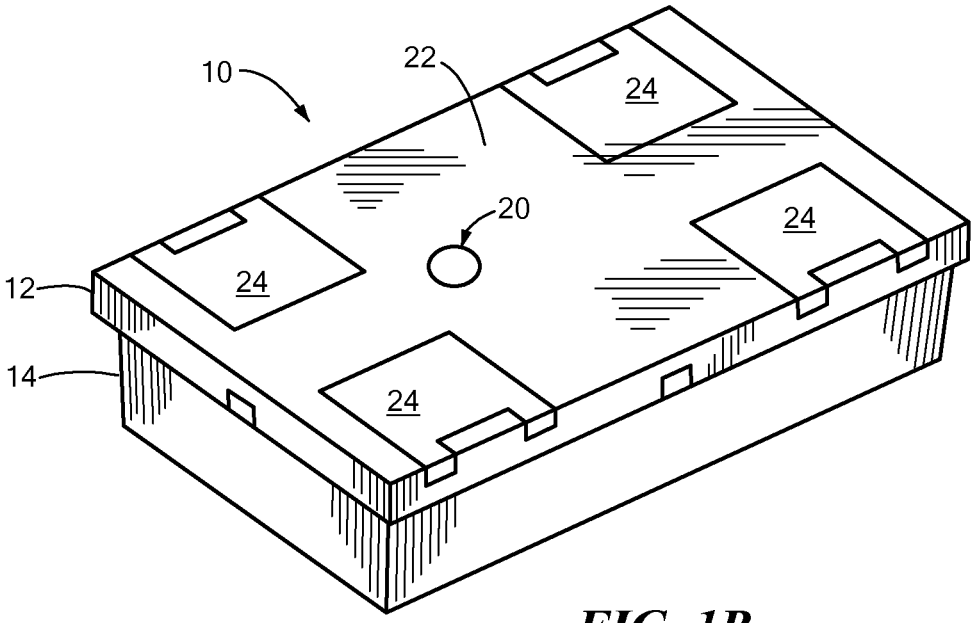
FIG. 1B schematically shows a bottom perspective view of the package microphone of FIG. 1A.

As shown in FIG. 1B, the base 12 has an audio input port 20 that enables ingress of audio/acoustic signals into the internal chamber 22. In alternative embodiments, however, the input port 20 is at another location, such as through the top of the lid 14, or through one of the side walls of the lid 14. Audio signals entering the internal chamber 22 interact with the MEMS microphone 16 to produce an electrical signal that, with additional (exterior) components (e.g., a speaker and accompanying on-chip or off-chip circuitry), produce an output audible signal corresponding to the input audible/acoustic signal.

As discussed below, the package may have additional ports/apertures. For example, the package could have a second input port (not shown) for directional sound purposes, or, in various embodiments, have a separate valve port (discussed below).

FIG. 1B also shows a number of base contacts 24 for electrically (and physically, in many anticipated uses) connecting the MEMS microphone 16 with a substrate, such as a printed circuit board or other electrical interconnect apparatus. The packaged microphone 10 may be used in any of a wide variety of applications. For example, the packaged microphone 10 may be used with mobile telephones, landline telephones, computer devices, video games, biometric security systems, two-way radios, public announcement systems, camcorders, and other devices that transduce signals.

In illustrative embodiments, the package base 12 shown in FIGS. 1A and 1B is a premolded, leadframe-type package (also referred to as a "premolded package"). Other embodiments may use different package types, such as, among other types, ceramic cavity packages, substrate package, or laminate base packages. Accordingly, discussion of a specific type of package is for illustrative purposes only.

The package 12 may have selective metallization to protect it from electromagnetic interference. For example, the lid 14 could be formed from stainless steel, while the substrate could include printed circuit board material, such as FR-4 substrate material. Alternatively, the lid 14 could be formed from an insulator, such as plastic, with an interior conductive layer. Other embodiments contemplate other methods for forming an effective Faraday cage that reduces electromagnetic interference with the internal MEMS microphone 16

Figure 2:
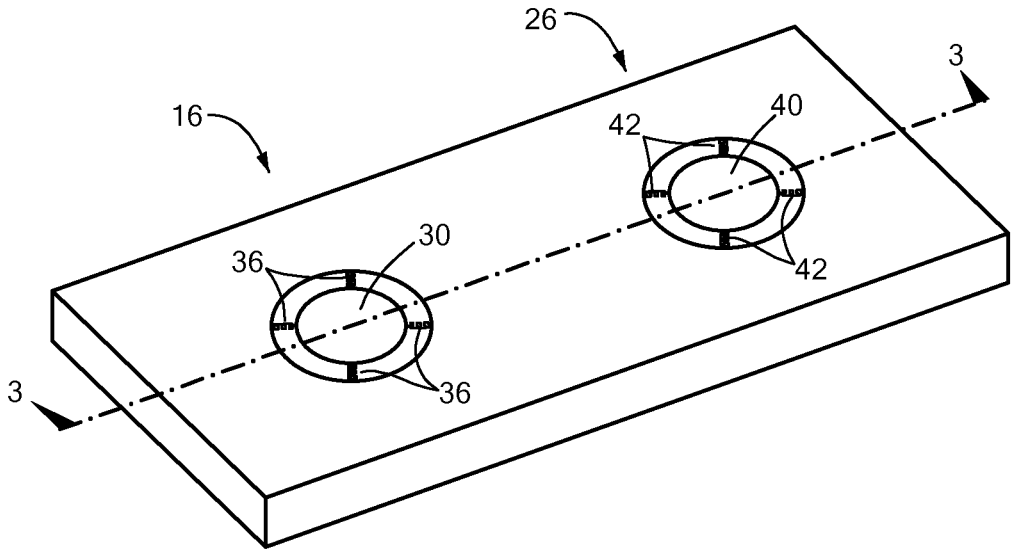
FIG. 2 schematically shows a top perspective view of one embodiment of a MEMS device having a valve in accordance with illustrative embodiments of the invention.
Figure 3A:
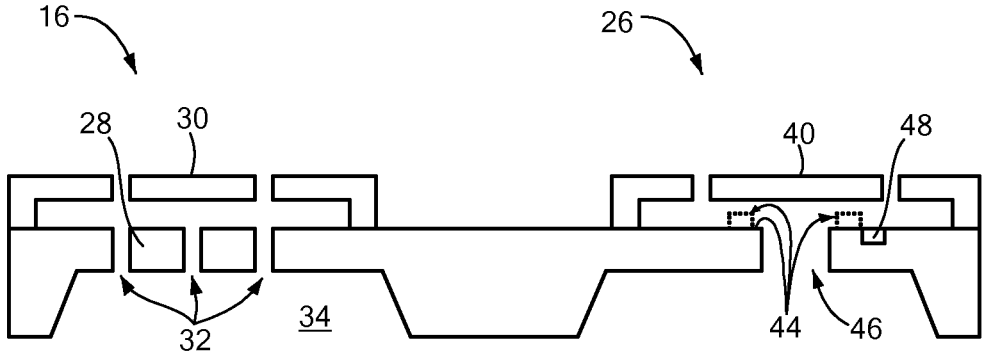
FIG. 3A schematically shows a cross-sectional view of the MEMS device of FIG. 2 along line 3-3. This view shows the valve in an open mode.

The internal chamber 22 may contain any of a variety of different microphone types. FIG. 2 schematically shows one microphone type with an integral, on-chip valve 26 (discussed below). FIG. 3A schematically shows a cross-sectional view of the microphone system shown in FIG. 2 along line 3-3.

Specifically, the MEMS microphone 16 preferably is a MEMS microphone die fabricated by conventional micromachining processes. To that end, the MEMS microphone 16 has, among other things, a static backplate 28 (FIG. 3A and later) that supports and forms a variable capacitor with a flexible diaphragm 30. In illustrative embodiments, the backplate 28 is formed at least in part from single crystal silicon (e.g., the top layer of a silicon-on-insulator wafer), while the diaphragm 30 is formed at least in part from deposited polysilicon. Other embodiments, however, use other types of materials to form the backplate 28 and the diaphragm 30. For example, a single crystal silicon bulk wafer, or some deposited material, may at least in part form the backplate 28. In a similar manner, a single crystal silicon bulk wafer, part of a silicon-on-insulator wafer, or some other deposited material may form at least part of the diaphragm 30. To facilitate operation, the backplate 28 has a plurality of through-holes 32 that lead to a backside cavity 34 (FIG. 3A and subsequent figures).

Springs 36 movably connect the diaphragm 30 to the static portion of the MEMS microphone 16, which may be considered to form a substrate. The springs 36 may be formed in any manner known to work for the intended purposes. For example, the springs 36 can take on a serpentine shape and thus, be considered serpentine springs. Audio/acoustic signals cause the diaphragm 30 to vibrate, thus producing a changing capacitance. On-chip or off-chip circuitry (not shown) receives (via contacts 24) and converts this changing capacitance into electrical signals that can be further processed. It should be reiterated that discussion of the specific microphone shown is for illustrative purposes only. Other microphone configurations thus may be used with illustrative embodiments of the invention.

The MEMS microphone 16 may be mounted in any of a plurality of different locations within the internal chamber 22 of the package. In the embodiment shown in FIG. 4A, discussed in greater detail below, the microphone 16 is mounted directly over the input port 20. Accordingly, as known by those in the art, the enclosed region on the other side of the diaphragm 30 (i.e., the side opposite the input port 20) is considered the "backvolume 38." As shown in the figures, the backvolume 38 may or may not include the backside cavity 34.

In accordance with illustrative embodiments of the invention, the system also has a fluid flow controller—a valve 26 in this case—that controls fluid flow in and out of the backvolume 38. In other words, the flow controller controls the resistance of fluid flow into the backvolume 38, which enables direct control of the low frequency cutoff of the microphone system.

Many applications can benefit by having this ability to vary the low frequency cutoff. For example, as noted above, the microphone 16 may be part of a camcorder. When recording outside, the valve 26 may adjust the low frequency cutoff to a higher value to remove wind noise. When indoors, however, the valve 26 may adjust the low frequency cutoff to a lower value to detect a wide range of audio signals. An operator can manually make this adjustment, or it can be automatically/dynamically adjusted (see below).

To those ends, FIGS. 2, 3A, and 4A schematically show the valve 26 and its relationship with the microphone 16 and backvolume 38 in accordance with one embodiment. It should be noted that FIG. 4A (like FIGS. 4B-4D) merely schematically shows the valve 26 and thus, the specific position or configuration of its movable member is not intended to contradict its placement or configuration shown in FIG. 3A.

As noted above, the valve 26 in this embodiment is integrated onto the same die as the microphone 16. To that end, the valve 26 may be fabricated by the same processes, have similar components, and function in a similar manner. In some embodiments, the valve 26 may have a movable member 40 that is flexibly connected to a stationary substrate by means of a plurality of serpentine springs 42 (shown schematically in FIG. 2).

Figure 3B:
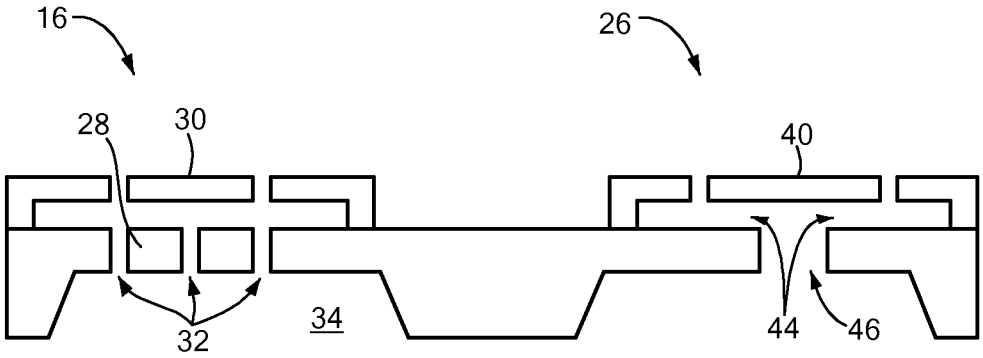
FIG. 3B schematically shows a cross-sectional view of the MEMS device of FIG. 2 along line 3-3. This view shows the valve in another open mode.
Figure 3C:
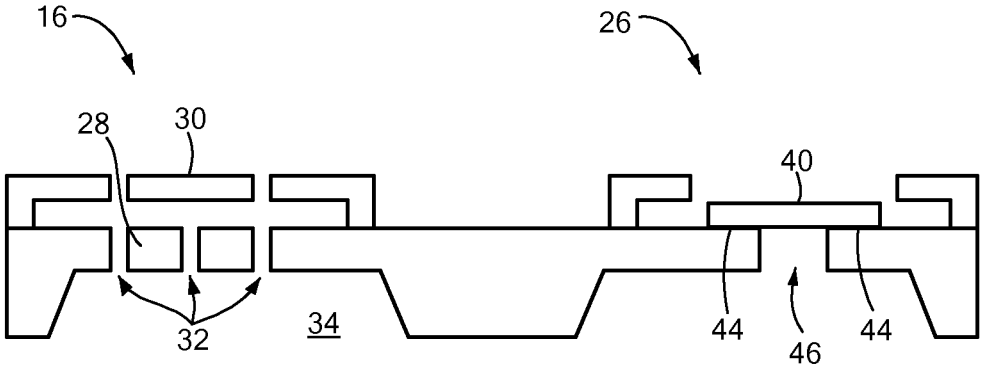
FIG. 3C schematically shows a cross-sectional view of the MEMS device of FIG. 2 along line 3-3. This view shows the valve in a closed mode.

A valve seat 44 circumscribing a valve aperture 46 through the substrate cooperates with the movable member 40 to selectively open and close the valve 26. This valve seat 44 may be a raised surface (reducing stiction, discussed below), as FIG. 3A shows in phantom, or simply be part of the smooth top surface of the substrate, as shown in FIGS. 3B and 3C. In illustrative embodiments, the movable member 40 is movable into and out of contact with a valve seat 44 to selectively open and close the valve aperture 46. To that end, the movable member 40 moves in a direction that is generally perpendicular to the substrate/valve seat 44.

The valve 26 is considered to be in a closed mode when the movable member 40 substantially closes the valve aperture 46, as shown in FIG. 3C. Those skilled in the art should understand that there could be some incidental leakage when in the closed mode. Accordingly, illustrative embodiments do not necessarily provide a rigorous fluid tight seal when in the closed mode. Instead, the strength of the seal of the closed mode should be determined based upon the application.

Conversely, the valve 26 is considered to be in an open mode when the movable member 40 does not substantially close the valve aperture 46. For example, FIG. 3A schematically shows one open mode, in which this embodiment is at rest (i.e., no actuation) and thus, fully open. FIG. 3B schematically shows a second open mode, which is an intermediate state between this fully open mode and the closed mode shown in FIG. 3C. This second open mode is expected to provide more fluid resistance than the state shown in FIG. 3A, but less fluid resistance than the state shown in FIG. 3C. It also should be noted that the open mode of FIG. 3B is but one of a plurality of potential open modes of the valve 26 between the modes of FIGS. 3A and 3C.

Electrodes 48 on the stationary portion of the valve 26 (e.g., on its substrate) control the mode of the valve 26. For example, upon actuation, the movable member 40 may traverse a very short distance, such as about 3 microns, when moving from the closed mode of FIG. 3C to the open mode of FIG. 3A. Accordingly, the figures are not drawn to scale. Again, as noted, the movable member 40 traverses in a generally perpendicular direction, generally toward or away from the valve seat 44.

As an example, an external or internal valve controller 50 (discussed below with reference to FIG. 6) may electrostatically actuate the electrodes 48 to open or close the valve 26 as shown in FIGS. 3A-3C. Specifically, in the embodiments shown, with no actuation, the movable member 40 normally is in the open mode—its most open position. To closed the valve 26, the electrodes 48 on the substrate electrostatically attract the movable member 40 toward the valve seat 44. To that end, the movable member 40 also may have electrodes (not shown) on its bottom face, or it simply may be doped and thus, electrostatically attracted to the electrodes 48 on the substrate. In fact, as noted below, the amplitude of the electrostatic actuation signal may vary to correspondingly vary the position of the movable member 40. This permits fine tuning of the valve 26 to precisely controlled the low frequency cutoff of the system.

Some embodiments operate under an opposite principal; namely, the valve 26 is normally in a closed position and requires electrostatic actuation to open it. FIGS. 4A-4D, discussed below, schematically show such a design. Each of those embodiments, however, can incorporate other types of valves, such as those shown in FIGS. 3A-3C.

It thus should be noted that the springs 42 can bias the valve 26 to any position. Specifically, the (valve) springs 42 could normally bias the movable member 40 to a fully closed position. In that case, to open the valve 26, the electrostatic actuation force would move the movable member 40 toward the open position. Alternatively, the springs 42 could normally bias the movable member 40 to a fully open position. Thus, to open the valve 26, the electrostatic actuation force would move the movable member 40 toward the closed position.

Intentionally causing the movable member 40 to contact the valve seat 44 (to close the valve 26) is contrary to the conventional wisdom known to the inventors. Specifically, in MEMS devices, movable microstructures undesirably commonly stick to other components, such as fixed microstructures. In this case, the risk is that the movable member 40 will stick to the valve seat 44, thus rendering the entire microphone system non-functional. This problem, often referred to as "stiction," is particularly challenging in the MEMS microphone space due to the fact that, to receive the acoustic signal, the MEMS microstructure must be exposed in some manner to the external environment, which often contains moisture. Despite this challenge, the inventors developed this valve technology to reduce the size of the valve 26 and maintain reasonable robustness.

To that end, the contact surfaces of the movable member 40 and valve seat 44 may be processed in any number of manners to mitigate the risk of stiction. For example, one or more of the surfaces may be processed to increase their hydrophobicity. Among other ways, one or more of the surfaces may be processed in the manner described in U.S. Pat. No. 6,674,140, with the title, "Process for Wafer Level Treatment to Reduce Stiction and Passivate Micromachined Surfaces and Compounds Used Therefor," assigned to Analog Devices, Inc., and naming John R. Martin as inventor. Alternatively, one or both of the surfaces may be textured or otherwise processed (e.g., with a raised valve seat 44) to further reduce stiction. The inventors anticipate that surfaces processed in this manner should produce satisfactory results.

Opening the valve 26 reduces the flow resistance into the backvolume 38. In that case, the low frequency cutoff of the microphone 16 should be relatively high and thus, eliminate or substantially mitigate low frequency audio signals. If low frequency signals are desired in a given application, however, the valve controller 50 may actuate the electrodes 48 to increase flow resistance into the backvolume 38, thus decreasing the low frequency cutoff. In either case, as noted above, the valve controller 50 also has the option of not fully opening or fully closing the valve 26. Instead, rather than fully closing the valve 26, the valve controller 50 may adjust the valve 26 to permit less fluid therethrough. In like manner, the valve controller 50 may adjust the valve 26 to permit more fluid therethrough.

Other valve types that operate in a similar manner may suffice for a given application. For example, the package 12 may have a manual flapper valve, a resistively controlled valve, or other type of valve that can provide the fluid resistance control controlling function in the manner discussed.

As shown in FIG. 4A, the chip having both the microphone 16 and valve 26 can be mounted over the input port 20. In alternative embodiments, the valve 26 may be separate from the microphone 16. FIG. 4B schematically shows one such embodiment, in which the microphone 16 and valve 26 are on separate chips/dies spaced apart within the internal chamber 22. As shown, the microphone 16 is secured over the input port 20, while the valve 26 is secured over a different package port 49.

Some embodiments do not mount both the valve 26 and microphone 16 over package ports. FIG. 4C schematically shows one such embodiment, in which neither the microphone 16 nor the valve 26 are mounted over a package port. In this embodiment, the microphone 16 and valve 26, which are on a single chip, are mounted to a closed surface of the internal chamber 22, i.e., not mounted on an opening to the package 12. The backvolume 38 should include both the region between the valve 26 and the bottom of the package 12, as well as the backside cavity 34 of the microphone 16. In this embodiment shown in FIG. 4C, the valve 26 directly bounds the backvolume 38.

Compared to the embodiment of FIG. 4A, for example, this embodiment has a small backvolume 38. Despite this, the valve 26 still controls the backvolume fluid flow resistance and thus, the low frequency cutoff. Another similar embodiment has both the valve 26 and microphone 16 on a solid surface, but spaced apart on separate chips. Yet other embodiments may position the valve 26 over a valve package port 49, but position the microphone 16 on a solid interior surface (not shown).

FIG. 4D schematically shows another embodiment having the microphone 16 positioned over the input port 20 while the valve 26 is positioned on a solid surface.

The embodiments described herein may include a single valve 26, or multiple valves 26. Accordingly, discussion of a single valve 26 is for illustrative purposes only and not intended to limit the scope of various embodiments. Multiple valves may enable fine tuning of the backvolume 38 and thus, the low frequency cutoff of the microphone system.

Figure 5:
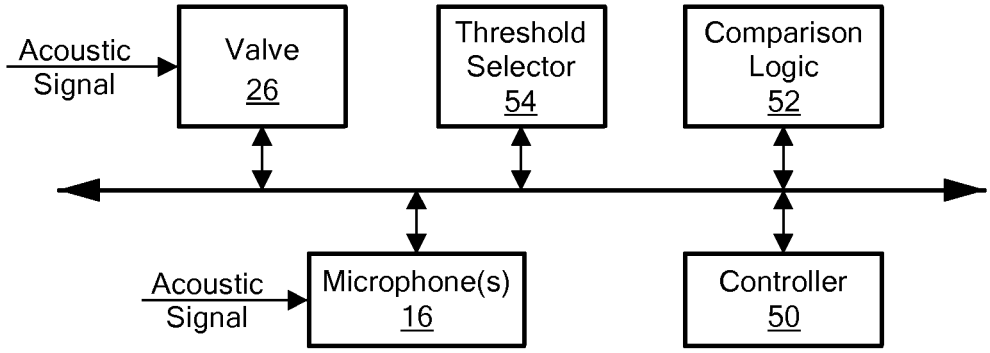
FIG. 5 schematically shows a block circuit diagram for controlling microphone system performance in accordance with illustrative embodiments of the invention.

FIG. 5 schematically shows a block circuit diagram for controlling microphone system performance in accordance with illustrative embodiments of the invention. For completeness, this figure also schematically shows the valve 26 and the MEMS microphone 16. In addition, the circuit includes comparison logic 52 that compares the noise in an incoming acoustic signal with a threshold amount of noise ("threshold noise amount") for dynamically changing the low frequency cutoff point during use (on the fly). Either the MEMS microphone 16, which delivers the signal intended to be delivered downstream may provide this incoming acoustic signal, or some alternative microphone (not specifically shown, but schematically represented in FIG. 6 by the "Microphone(s)" block) dedicated principally to determining the amount of noise in the incoming acoustic signal. Specifically, the system may have another microphone (e.g., an external microphone) with a fixed and wide dynamic range that delivers the incoming acoustic signal. In other words, unlike the MEMS microphone 16 discussed above, the low frequency cutoff point of this other microphone is not dynamically movable.

A threshold selector 54 provides the threshold noise amount, which may be a dynamic or static value. For example, the threshold noise amount may be preprogrammed in nonvolatile memory, or dynamically changed during use. As discussed in greater detail below in FIG. 6, the circuit also has a controller 50 that controls operation of the valve 26 as a function of the comparison made by the comparison logic 52. These components are electrically coupled in any conventional manner. For example, FIG. 5 shows a generalized parallel bus. It nevertheless should be noted that these components may be connected by other means, such as serially, or a combination of a serial and parallel connection.

Figure 6:
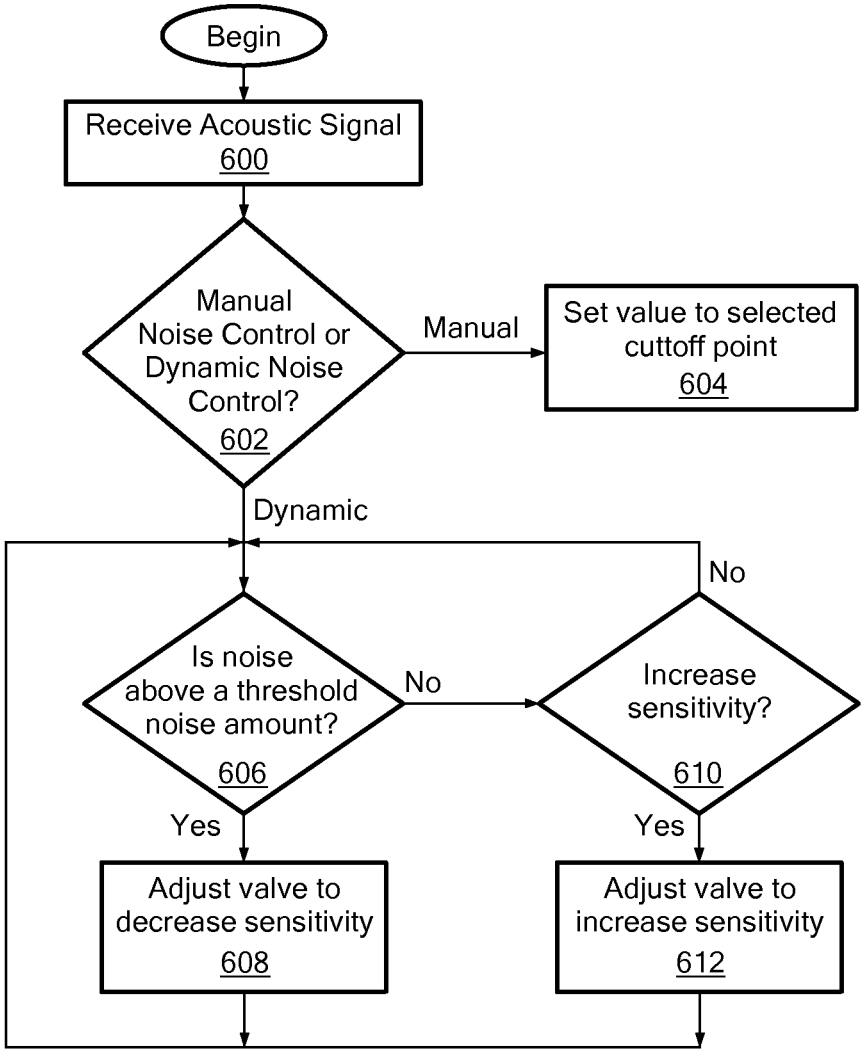
FIG. 6 shows a process of controlling the microphone system in accordance with illustrative embodiments of the invention.

FIG. 6 shows a process of controlling the microphone system in accordance with illustrative embodiments of the invention. It should be noted that for simplicity, this described process is a significantly simplified version of an actual process used to control the microphone system. Accordingly, those skilled in the art would understand that the process may have additional steps and details not explicitly shown in FIG. 6. Moreover, some of the steps may be performed in a different order than that shown, or at substantially the same time. Those skilled in the art should be capable of modifying the process to suit their particular requirements.

The process begins at step 600, in which the MEMS microphone 16 receives an acoustic signal. Next, step 602 determines if the system is set to a manual noise control mode or a dynamic noise control mode. Specifically, when in a manual noise control mode, the threshold selector 54 is programmed to set the low frequency cutoff at a specific point.

For example, when integrated into a camcorder, a user may push a "manual mode" button on the camcorder to manually set the sensitivity of microphone system. After pressing the manual mode button, the display may enable user to select between a plurality of different sensitivities, such as "high sensitivity," "medium sensitivity," and "low sensitivity." Each of these settings sets the low frequency cutoff to fixed but different frequencies. Thus, the low sensitivity setting could be selected when the camcorder is used outdoors on a windy day, while the high sensitivity setting can be set when the camcorder is used indoors. For a more sophisticated user, the manual mode could enable user to select an exact low frequency cutoff point.

Accordingly, if step 602 determines that the system is in the manual noise control mode, then the process continues to step 604, in which the controller 50 sets the valve 26 to the low frequency cutoff point corresponding with the selected sensitivity. Conversely, if the system is in the dynamic noise control mode, then the process continues to step 606. Specifically, in the dynamic noise control mode, the valve 26 dynamically changes the low frequency cutoff point during use as a function of the noise detected in the incoming acoustic signal. To that end, the comparison module detects the amount of noise, if any, in an incoming acoustic signal. As noted above, the microphone 16 itself, or a second microphone dedicated only to noise detection, can deliver this acoustic signal.

Accordingly, at step 606, the comparison logic 52 determines if the noise in the incoming acoustic signal exceeds the threshold noise amount as specified by the threshold selector 54. If it exceeds the threshold noise amount, then step 608 causes the controller 50 to adjust the valve 26, consequently changing the low frequency cutoff point to higher frequency. For example, the controller 50 may increase the frequency cutoff point by a predetermined incremental amount. The process then loops back to step 606, which again determines if the noise is above the threshold amount. This process continues until the low frequency cutoff point is set to a value that causes the noise to be below the threshold noise amount.

If the comparison logic 52 at step 606 determines that the noise in the incoming acoustic signal is not above the threshold noise amount, then the process continues to step 610, in which the comparison logic 52 determines if the sensitivity should be increased. Specifically, at this stage of the process, the amount of noise in the acoustic signal is at some unknown amount below the threshold noise amount. Remaining at a higher low frequency cutoff thus may unnecessarily limit the sensitivity of the microphone system. Accordingly, the comparison logic 52 and controller 50 may use conventional techniques to determine if the sensitivity can be increased. For example, the controller 50 may sample the incoming acoustic signal to determine the noise level. If the noise level is less than some second threshold noise amount, then the sensitivity of the microphone system may be increased. As noted, the second threshold amount should be less than the threshold amount discussed above with step 606.

Accordingly, to increase the sensitivity, the process continues to step 612, which adjusts the valve 26 to increase the sensitivity of the microphone system. As noted above, this involves moving the movable member 40 in a manner that reduces the air flow into the backchamber. After adjusting the sensitivity, the process loops back to step 606. Conversely, at step 610, if the sensitivity is not to be increased, then the processing also loops back to step 606, without adjusting the valve 26.

Illustrative embodiments thus provide both 1) low frequency sensitivity, currently provided by high-performance microphones, and 2) noise mitigation without requiring additional noise removing circuitry and filters or additional microphones. These benefits are achieved in a MEMS microphone system design that does not require significant system real estate.

Although the above discussion discloses various exemplary embodiments of the invention, it should be apparent that those skilled in the art can make various modifications that will achieve some of the advantages of the invention without departing from the true scope of the invention.

What is claimed is:

1. A microphone system comprising:

a package having an interior and defining at least one input aperture for receiving an acoustic signal;

a MEMS microphone mounted within the interior of the package and mechanically coupled to at least a portion of one input aperture in the package, the microphone having a backvolume defined by the microphone and package; and a MEMS valve coupled with at least one input aperture in the package, the valve having a valve opening generally circumscribed by a valve seat, the valve having an open mode for permitting acoustic signal access into the package interior through the valve opening, the valve also having a closed mode for substantially preventing acoustic signal access into the package interior through the valve opening, the valve having a movable member configured to contact the valve seat when in the closed mode, the movable member being configured to move between the open mode and the closed mode in a direction that is generally perpendicular to the valve seat.

2. The microphone system as defined by claim 1 wherein the movable member substantially covers the valve opening when in the closed mode.

3. The microphone system as defined by claim 1 wherein the movable member is electrically conductive and electrostatically attracted toward and away from the valve seat.

4. The microphone system as defined by claim 1 wherein the valve comprises a serpentine spring that controls movement of the movable member between the closed mode in the open mode.

5. The microphone system as defined by claim 1 wherein the valve comprises a main surface forming the valve opening, the valve seat comprising a raised surface protruding from the main surface.

6. The microphone system as defined by claim 1 wherein the valve comprises a main surface forming the valve opening, the valve seat comprising a portion of the main surface.

7. The microphone system as defined by claim 1 wherein the valve has a fully open position, a fully closed position, and a plurality of intermediate positions between the fully open and fully closed positions, the valve being configured to stop the movable member at any one of the intermediate positions for a predetermined amount of time during use.

8. The microphone system as defined by claim 1 wherein the microphone and valve are mounted over the same input aperture.

9. The microphone system as defined by claim 1 wherein the microphone and valve are formed on a single die.

10. The microphone system as defined by claim 1 further comprising a noise detector coupled with the valve and configured to detect noise received by the microphone, the noise detector being configured to reduce noise sensitivity of the microphone after detecting noise.

11. The microphone system as defined by claim 1 wherein the valve comprises a flapper valve.

12. A microphone system comprising:

a package having an interior and defining at least one input aperture for receiving an acoustic signal, the package having an electromagnetic interference mitigation shield;

a MEMS microphone mounted within the interior of the package, the microphone having a backvolume defined by the microphone and package; and a MEMS valve acoustically coupled with at least one input aperture in the package, the valve having a valve opening generally circumscribed by a valve seat, the valve having an open mode for permitting acoustic signal access into the package interior through the valve opening, the valve also having a closed mode for substantially preventing acoustic signal access into the package interior through the valve opening, the valve having a movable member configured to contact the valve seat when in the closed mode, the movable member being configured to move between the open mode and the closed mode in a direction that is generally perpendicular to the valve seat.

13. The microphone system as defined by claim 12 wherein the movable member is generally constrained to move in a direction that is generally perpendicular to the valve seat only.

14. The microphone system as defined by claim 12 wherein the MEMS microphone and valve are formed on the same die and mechanically coupled with the same input aperture.

15. The microphone system as defined by claim 12 wherein the valve has a fully open position, a fully closed position, and a plurality of intermediate positions between the fully open and fully closed positions, the valve being configured to stop the movable member at any one of the intermediate positions for a predetermined amount of time during use.

16. A method of controlling a microphone, the method comprising:

providing a MEMS microphone system having a package forming an input aperture, the package also having an interior containing a microphone having a low frequency cutoff, the microphone and package forming a backvolume, the microphone system also having a MEMS valve with a valve seat and an opposed movable member;

moving the movable member of the valve generally perpendicularly toward or generally perpendicularly away from the valve seat to vary the fluid flow resistance into the backvolume to control the low frequency cutoff of the microphone; and receiving an incident acoustic signal through the input aperture, the microphone responding to the incident acoustic signal as a function of the low frequency cutoff of the microphone as controlled by the valve.

17. The method as defined by claim 16 further comprising electromagnetically shielding the interior of the package.

18. The method as defined by claim 16 wherein the movable member directly contacts the valve seat when the valve is in a closed mode.

19. The method as defined by claim 16 further comprising detecting noise in an acoustic signal, and controlling the valve to move the movable member in response to the noise.

20. The method as defined by claim 16 further comprising:

manually selecting a mode of the valve; and controlling the movable member to one of a plurality of modes in response to the manual selection.

* * * * *